US005156034A

United States Patent [19]

Lorbach

[11] Patent Number: 5,156,034

[45] Date of Patent: Oct. 20, 1992

[54] CONTOURING OF METAL SHEETS

[75] Inventor: Karl E. Lorbach, Cairns, Australia

[73] Assignee: K.P.G. Integrated Engineering Pty. Ltd., Clifton Beach, Australia

[21] Appl. No.: 656,084

[22] PCT Filed: Aug. 30, 1988

[86] PCT No.: PCT/AU88/00334

§ 371 Date: Feb. 26, 1991

§ 102(e) Date: Feb. 26, 1991

[87] PCT Pub. No.: WO90/02005

PCT Pub. Date: Mar. 8, 1990

[51] Int. Cl.[5] ..... B21D 5/14

[52] U.S. Cl. ..... 72/20; 72/133; 72/226

[58] Field of Search ..... 72/20, 22, 133, 178, 72/226, 420

[56] References Cited

U.S. PATENT DOCUMENTS

| | | | |
|---|---|---|---|
| 1,710,262 | 4/1929 | Kellogg . | |
| 2,964,089 | 12/1960 | Kunz | 72/226 |
| 3,333,451 | 8/1967 | Inlow | 72/133 |
| 3,392,566 | 7/1968 | Sporck | 72/377 |
| 4,142,393 | 3/1979 | Nagel . | |
| 4,557,129 | 12/1985 | Lash et al. . | |
| 4,702,099 | 10/1987 | Sturm | 72/20 |
| 4,857,412 | 8/1989 | Fleury . | |
| 4,974,435 | 12/1990 | Vandenbroucke | 72/226 |

FOREIGN PATENT DOCUMENTS

| | | |
|---|---|---|
| 2816993 | 10/1979 | Fed. Rep. of Germany . |
| 57-118821 | 7/1982 | Japan . |
| 333675 | 8/1930 | United Kingdom . |
| 338091 | 11/1930 | United Kingdom . |
| 477592 | 12/1937 | United Kingdom . |
| 780169 | 7/1957 | United Kingdom . |

*Primary Examiner*—Lowell A. Larson

*Attorney, Agent, or Firm*—Merchant, Gould, Smith, Edell, Welter & Schmidt

[57] ABSTRACT

An apparatus for contouring plastically deformable sheet material comprises a pair of opposed indexable turret assemblies (2, 3) each including a plurality of shaping rollers (4) comprising either solid rollers (30, 31) or split rollers (32, 33). Opposed shaping rollers (30, 31 or 32, 33) respectively have generally complementary convexly and concavely shaped circumferential profiles (30*a*, 31*a*). Upper turret assembly (3) is displaceable relative to lower turret assembly (2) by means of a fluid powered ram (10) under the control of displacement measuring means (18) and/or pressure sensing means 911). The apparatus is controlled by a microprocessor (20) which determines from stored data the optimum combination of rollers (30, 31 or 32, 33) and rolling pressure in ram (10) to achieve the required sheet material deformation and to ensure that the transverse area of contact between the rollers (30, 31 or 32, 33) and the sheet material to be deformed does not fall below a length to width ratio of 3:1. Video camera (28) are used to monitor alignment of sheet material and rollers (30, 31 or 32, 33) and should any deviation occur then signals from video cameras (28) are processed by the microprocessor (20) to correct the forming mode.

18 Claims, 3 Drawing Sheets

CONTOURING OF METAL SHEETS

This invention is concerned with the contouring of planar metal sheets and is particularly although not exclusively suitable for contouring of metal sheets for ship building purposes.

The invention is concerned in one aspect with an apparatus for contouring metal sheets and in another aspect with a method for contouring metal sheets. The invention is concerned also with articles comprising or embodying metal sheets made in accordance with the method or apparatus.

Hitherto, contouring planar metal sheets to form three dimensional shapes with simple or compound curvatures has been achieved by a number of means. Typical of such contouring methods are:- heat stretching and shrinking; stretching wheeling rollers; edge shrinking; press and die stamping; shot blasting and peening.

Press and die stamping can produce accurately contoured articles from planar metal sheets using relatively unskilled labour. However in view of the extremely high capital cost of the press and the dies, this process is usually limited to high volume repetitive operations producing articles such motor vehicle body panels.

Shot blasting and peening is generally only confined to relatively thin sheets of soft metals such as aluminum and this process has been used in shaping of aircraft wing skin sections.

The other prior art processes involving heat shrinking and stretching, stretching wheeling rollers and edge shrinking all suffer serious disadvantages. Apart from being very labour intensive and slow, these processes all require an extremely high level of skill and generally produce only mediocre results. With current management practices relating to employment and training of skilled labour, there is a rapidly diminishing number of tradesmen skilled in the art of contouring metal sheets.

While the following description is limited to contouring of metal sheets for use in ship building, it will be abundantly clear to a skilled addressee that the method and apparatus of the present invention are applicable to a wide range of fields requiring contoured sheet material comprised of a plastically deformable material.

Because of the lack of skilled labour and otherwise high labour costs associated with the ship building industry, marine architects have adopted alternative design criteria to achieve cost efficient ship construction in a very competitive industry. Although such design criteria have permitted simpler shell plate profiles to utilize a less skilled labour force, the craft so constructed are not necessarily cost efficient in terms of operational costs nor do they necessarily possess the same characteristics of seaworthiness or structural soundness when compared with craft constructed to traditional configurations.

where cost is not the sole criteria as in the case of luxury motor yachts, the lack of skilled craftsmen and strict survey requirements often gives rise to a ships hull having such a poor shell plate appearance that up to five percent of the total construction cost of the vessel may be represented by the application of filler to disguise these imperfections.

Accordingly it is an aim of the present invention to overcome or alleviate the problems associated with prior art contouring of metal plates.

It is a further aim of the invention to provide an apparatus and method for accurate and reproducible contouring of metal plates.

According to one aspect of the present invention there is provided an apparatus for contouring sheet material, said apparatus comprising:

a support frame supporting at least two roller assemblies, said at least two roller assemblies being rotatable about spaced substantially parallel rotational axes;

drive means to rotatably drive a shaping roller associated with at least one of said roller assemblies;

proximity control means to displace at least one of said roller assemblies relative to another of said roller assemblies, said proximity control means being selectively operable under the influence of pressure sensing means and/or displacement measuring means.

Preferably respective said rotational axes of said at least two roller assemblies are aligned on an axis perpendicular to said rotational axes.

Suitably, one or more of said at least two roller assemblies comprises a rotatable turret assembly including a plurality of shaping rollers spaced about an outer portion of said turret assembly.

If required one or more of said shaping rollers may comprise a plurality of roller elements.

Preferably said apparatus comprises a driven shaping roller with a freely rotatable shaping roller spaced therefrom, the displacement between said driven roller and said freely rotatable roller being selectively adjustable.

Suitably an upper roller assembly is displaceable relative to a lower roller assembly along said axis perpendicular to said rotational axes.

Preferably displacement of said upper roller assembly is controlled by said proximity control means in response to a predetermined pressure applied by a shaping roller, associated with said upper roller assembly, to sheet material to be contoured. Alternatively, or in addition, displacement of said upper roller assembly is controlled by said proximity control means in response to a predetermined displacement between respective shaping rollers associated with said upper roller assembly and said lower roller assembly.

The apparatus preferably includes support means to support, in use, a sheet of material to be contoured.

Suitably said support means comprises one or more support surfaces movable to support a contoured sheet movable thereover.

If required said apparatus may include alignment means adapted to align a sheet of material relative to shaping rollers during contouring of said sheet of metal.

Preferably said apparatus includes microprocessor control means.

Suitably said upper roller assembly comprises a plurality of shaping rollers, having a cross-sectionally curved perimetral edge of substantially convex shape.

Suitable said lower roller assembly comprises a plurality of shaping rollers, having a cross-sectionally curved perimetral edge of substantially concave shape.

According to a further aspect of the invention there is provided a method for contouring sheet material, said method comprising: rolling a plastically deformable sheet material between opposed rollers along preselected tanging lines whereby the area of transverse surface contact between respective opposed rollers and a respective region of contact on said sheet material has a length to width ratio of greater than 3:1.

Preferably said area of contact has a length to width ratio of greater than 4:1.

More preferably said area of contact has a length to width ratio of greater than 5:1.

In order that the invention may be more readily understood, reference is now made to a preferred embodiment illustrated in the accompanying drawings in which.

Figure 1:
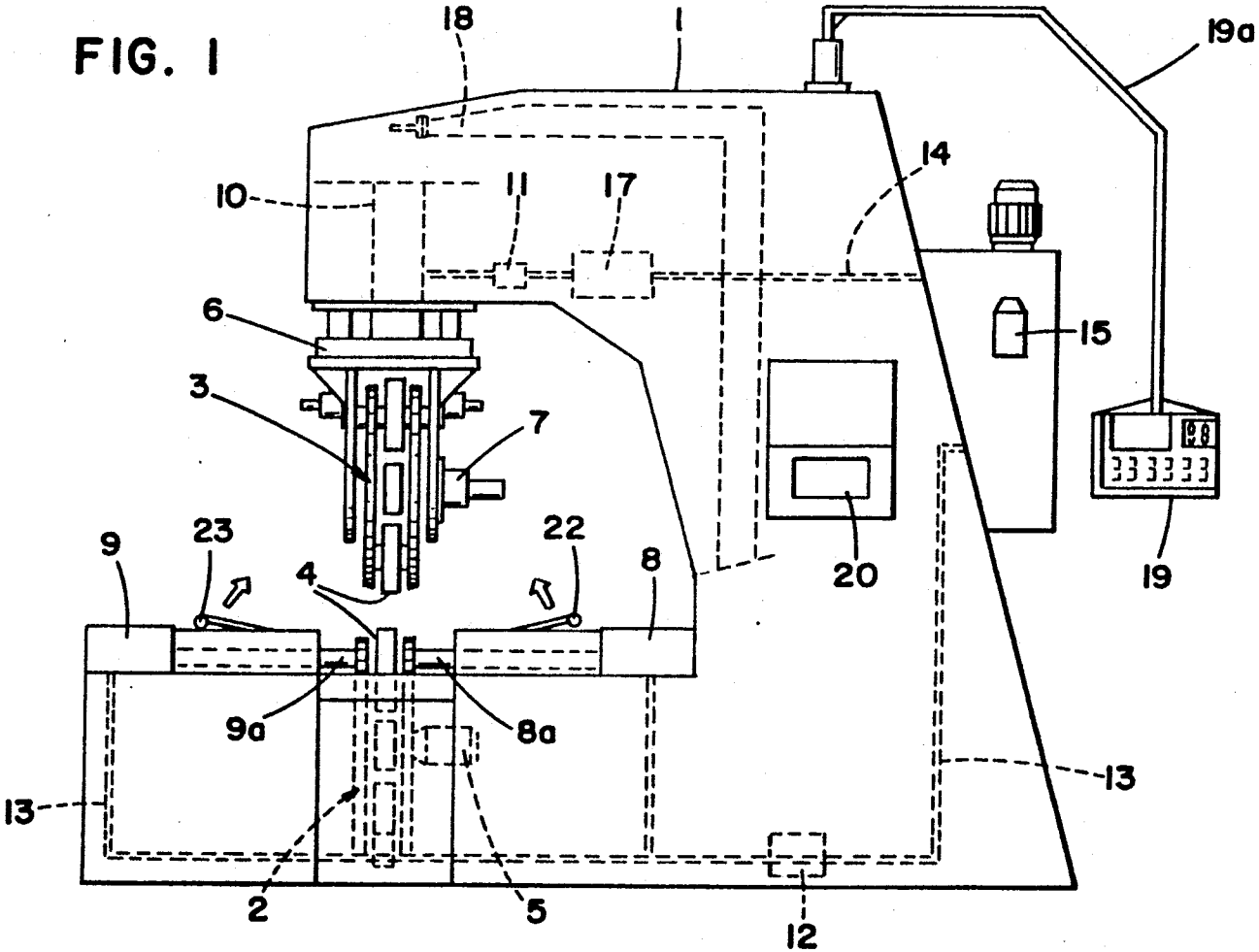
FIG. 1 is a schematic side elevation

In FIG. 1 the contouring apparatus comprises a support frame 1 supporting a lower roller assembly 2 and an upper roller assembly 3. Both upper and lower roller assemblies 2, 3 comprise rotatable turrets having a plurality of rotatably mounted shaping rollers 4 mounted about the periphery thereof.

Lower shaping rollers 4 are driven by hydraulically powered motors 8, 9 controlled by control valve means 12 in hydraulic circuit 13 connected to an hydraulic pump system 15. Rollers 4 are driven by retractable drive shafts 8*a*, 9*a* which selectively engage rollers 4 via a spigot and socket connection (not shown). Motors 8, 9 may be driven in unison, or, for reasons described later, they may be individually controlled. An indexing motor 5 rotates the turret assembly 2 to locate a selected shaping roller 4 in the required position in alignment with an upper shaping roller 4. Similarly, upper turret assembly 3 includes an indexing motor 7 for alignment of upper shaping roller 4. Upper rollers 4 are not powered and are permitted to "free wheel" during a contouring operation by virtue of fractional engagement with the upper surface of a sheet of metal to be contoured.

Turret assemblies 2, 3 comprise sets of rollers contoured to suit the nature of the sheet metal to be contoured as well as the nature of the contour to be formed. In the apparatus illustrated, upper rollers 4 have convex contouring surfaces of differing radii, whilst lower rollers 4 have concave contouring surfaces also of differing radii.

Upper turret 3 is rotatably mounted in a retractable bracket assembly 6 which is extended or retracted by means of hydraulic ram 10. The operation of ram 10 is controlled by a control valve 17 in hydraulic circuit 14 by means of a pressure sensor 11. The relative displacement between upper and lower shaping rollers 4 is measured by a highly accurate electronic micrometer device 18.

Hydraulically powered, individually tiltable support faces 22, 23 are provided on each side of turret assemblies 2, 3 to support a contoured metal plate as it passes between shaping rollers 4. Position sensors (not shown) are provided to determine the positions of support faces 22, 23 to enable individual control thereof by valve means (not shown) in the respective hydraulic circuits.

A control panel 19 including appropriate switches, signal lights and a VDU screen is supported on an arm 19*a* swingable from one side of the apparatus to the other. The control panel is used to select predetermined operational parameters to facilitate operation of the apparatus under the control of microprocessor 20.

Figure 2:
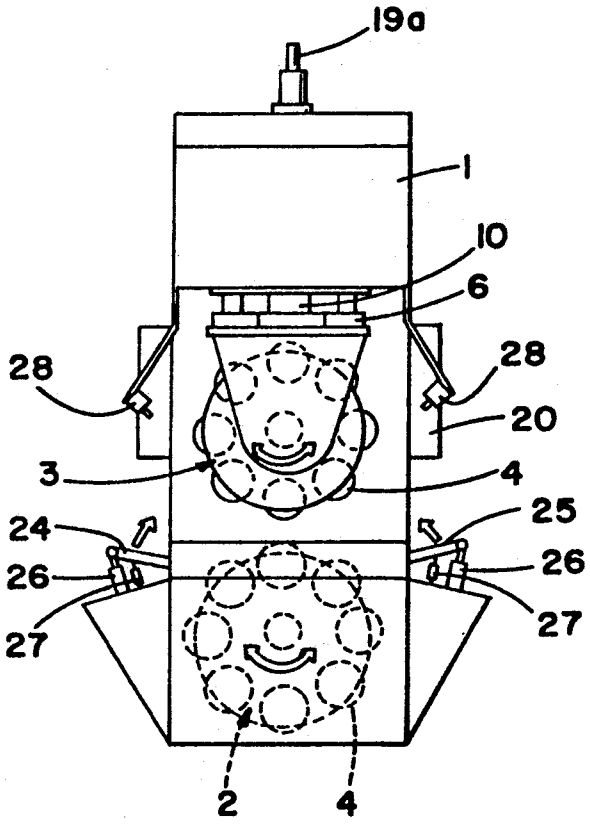
FIG. 2 is an end elevation of the arrangement of FIG. 1.

FIG. 2 shows a front end elevation of the apparatus of FIG. 1. On each side of turrets 2, 3 are further tiltable support faces 24, 25 actuated by hydraulic cylinders 26, each controllable to adopt a predetermined position by means of position sensors 27.

Positioned above and to each side of the contouring region between adjacent shaping rollers 4 are high resolution video cameras 28 aligned in the plane of rollers 4.

Figure 3:
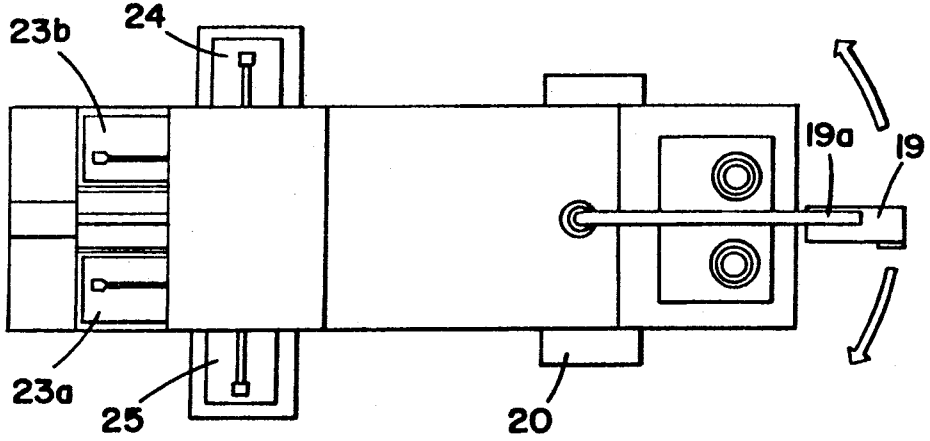
FIG. 3 is a top plan view of the arrangement of FIGS. 1 and 2.

FIG. 3 is a top plan view of the apparatus of FIGS. 1 and 2 showing support surfaces 23 as separately tiltable surfaces 23*a*, 23*b*. The support surfaces 22 illustrated in FIG. 1 are similarly separately tiltable.

Figure 4:
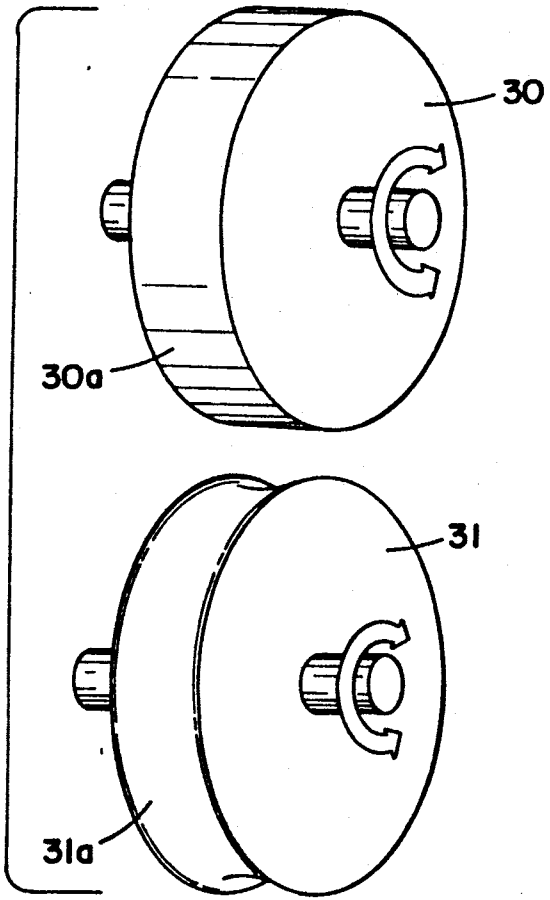
FIG. 4 shows a shaping roller assembly.

FIG. 4 illustrates a pair of solid convex and concave rollers 30, 31 which may be employed with the apparatus. The cross-sectionally curved convex and concave perimetral edges 30*a*, 31*a* are substantially complementary to the extent that they possess identical of substantially similar centres of curvature.

Figure 5:
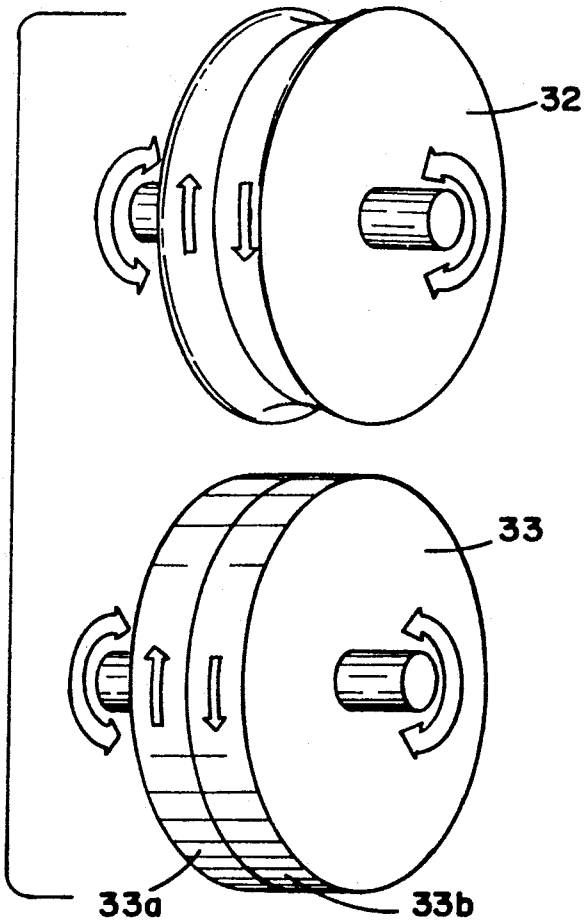
FIG. 5 shows an alternative shaping roller assembly.

FIG. 5 illustrates a pair of split convex and concave rollers 32, 33 which are most advantageously employed with the invention. By employing split upper and lower rollers with the lower roller halves 33*a*, 33*b* being independently driven by motors 8, 9 controlled contouring of a metal sheet may be achieved along non-linear tanging lines over the metal sheet.

In the formation of contoured metal plates using prior art stretching wheeling rollers it is customary to utilize combinations of convex and concave shaping rollers to achieve controlled curvature transverse to the rolling direction. Controlled curvature along the rolling direction is achieved by stretching the metal with a pair of convex rollers. In formation of curvatures transverse to the rolling direction of convex/concave combination of rollers is employed. With the concave shaping roller supporting the planar metal sheet with the peripheral edges each acting as a fulcrum, the convex roller is forced downwardly under pressure to deform the sheet as it passes through the rollers. Tanging lines are often marked on the sheet as a guide to the operator in development of a desired contour which is measured against a series of profile patterns during the rolling operation. Generally speaking, such contoured sheets are progressively developed by multiple rolling passes over the same tanging lines to avoid uncontrollable deformation due to stretching in a direction perpendicular to the required deformation. As the upper convex roller effectively "floats" on the surface of the metal sheet supported from beneath by the spaced edges of the concave roller, considerable skill and judgement are required to judge the sufficiency of the transverse deformation without causing stretching in the longitudinal direction. Further, due to the "floating" action of the deforming convex roller, inconsistencies in plate thickness and metal quality give rise to a rippled surface. Multiple passes over the same tanging line are thus necessary to avoid unwanted stretching but often this results in excessive work hardening in the contoured plate.

By fully supporting the metal sheet across the radius of curvature of the concave roller, the uncontrolled "floating" action of the upper convex roller is avoided. This degree of control alleviates the rippling normally encountered with prior art stretching wheeling processes. By control of ram pressure and/or roller displacement in conjunction with a pair of concave/convex complementary rollers of preselected radii of cross selectional peripheral curvature, the desired degree of deformation along a given tanging line can be effected with great precision without encountering unwanted (and uncontrollable) longitudinal stretching.

Surprisingly, it has been found that in the event that longitudinal stretching is required to develop a compound curve, additional pressure may be applied by the convex roller to achieve stretching without losing control of the transverse deformation. By changing roller combinations and/or ram pressure and/or roller displacement in a preselected manner throughout the length of a tanging line, extremely complex but otherwise accurate compound curvatures may be achieved in the contouring of a metal plate.

The apparatus and method of the present invention thus achieved the lower capital cost benefits of prior art stretching wheeling processes with the benefits of accuracy, speed and unskilled labour requirements of prior art press and die processes.

By careful and coordinated control of all deformation parameters complex and compound curvatures as well as simple curvatures may be achieved with the apparatus according to the invention. At the same time, as the metal plate is deformed with the minimum number of rolling passes, the resultant contoured plate is smoothly contoured and relatively stress free.

In the ship building industry CAD-CAM microprocessor software is readily available for profile cutting of sheel plate. During the cutting operation, tanging lines for contoured plates are preferably marked on the profiled plate.

In operation of the apparatus according to the invention, the profiled planar plate is placed in the support surfaces 22, 23, 24, 25 which initially are configured in a horizontal position.

Data relating to contour and planar profile are then entered into microprocessor 20 from the CAD-CAM software together with information relating to place thickness and the grade of metal from which the plate is formed.

The appropriate tanging line on the metal plate is then aligned with video cameras 28 before commencing operation of the apparatus.

Microprocessor 20 then determines from stored data the optimum combination of contouring rollers 4 and rolling pressure in ram 10 for the plate thickness and metallurgical grade to achieve the desired degree of deformation on each pass over a respective tanging line.

The required combination of shaping rollers 4 is obtained by indexing turret assemblies 2 and 3 and ram 10 is then actuated as drive motors 8, 9 are activated. When top shaping roller 4 frictionally engages the metal plate under pressure, lower driven shaping roller 4 moves the plate along the initial tanging line which is monitored by video cameras 28. If the tanging line becomes misaligned with the video cameras 28 or if the tanging is non linear, signals from the video camera are processed by the microprocessor 20 to selectively control the relative speeds of operation of the paired elements of split lower shaping roller 4 to guide the tanging line between the upper and lower shaping rolls. Directional changes are accommodated in top shaping roller 4 as it also comprises a split pair of elements which can independently free wheel.

For the development of a compound curve the pressure in ram 10 may be altered in a predetermined manner as the rollers progress over a tanging line.

At the end of each rolling pass of the metal plate the next tanging line is aligned with video cameras 28 and turrets 2, 3 are reindexed if required by microprocessor 20.

If required the apparatus of the present invention may be adapted to operate in a manner similar to prior art stretching and wheeling machines by the use of interchangeable roller turret assemblies using various combinations of convex and/or concave rollers.

Where a compound curvature is required with say a concave curve perpendicular to the direction of travel through the deforming rollers and a concave curve parallel to the direction of travel, this may be achieved by using a pair of concave/convex shaping rollers along predetermined tanging lines and a pair of convex rollers along the same or alternate tanging lines. The concave/convex pair of rollers form upwardly concave depression along the tanging line while the convex rollers tend to stretch the metal plate to form a downwardly concave deformation perpendicular to the tanging line.

With the present invention however, controlled deformation of the metal plate using a concave/convex complementary pair of shaping rollers is achieved by controlling the pressure in ram 10 having regard to known deformation characteristics of a particular metallurgical grade of metal sheet of a particular thickness with a particular radius of edge curvature of the complementary concave/convex roller combination having a given roller diameter. Compensation for thickness variation can be effected by signals output from micrometer device 18 which can monitor plate thickness by measuring relative displacement between upper and lower shaping rollers 4.

Similarly, controlled deformation of the metal plate may be achieved by monitoring and controlling the relative displacement between upper and lower shaping rolls. Variations in plate thickness may then be compensated by monitoring and controlling the hydraulic pressure in ram 10.

During the progressive shaping process support surfaces 22, 23, 24, 25 are tilted under the control of microprocessor 20 to correspond with respective adjacent portions of the contoured metal plate as it passes over the support surfaces. In this manner the deformed metal plate is correctly supported and the supports assist in guidance of the shaping rollers along the tanging lines.

Data relating to the deformation of metal plates to produce simple, complex and compound curvatures can be compiled by calculation from known properties and/or by empirical methods and calibration. It has been found in practice however that theoretical data may need to be modified slightly by experimentally determined data to achieve optimum results. Further, due to inconsistencies in the quality of certain metals it is desirable to test metal plate samples by simple standard deformation test methods to compensate for minor metallurgical variations from batch to batch. In this manner the microprocessor may be programmed to compute interpolated contouring control parameters to accommodate differing metal types, thicknesses and metallurgical variations permit a high degree of reproducibility in contoured metal plates.

Although it will be clear to a skilled addressee that there are many variables to be taken into account in selection of shaping roll diameter(s), roll edge curvature redii, roll pressure and roll displacement parameters, shaping roll speed etc. for use in connection with metal sheets of various thicknesses and metallurgical properties, these variables may be readily determined by calculation and/or experimentation. The data thus obtained is then able to be embodied in computer software for microprocessor control of the apparatus.

Of the various combinations of physical parameters which may be optimised in the working of the invention, it has been found that the area of contact between each shaping roller surface and the region of metal sheet being deformed should have a length:width ratio greater than 3:1 in the transverse direction in order to fully control the deformation process as ratios less than 3:1 give rise to uncontrollable deformation due to excessive stretching along a tanging line. Although good results can be obtained with a ratio of 4:1, the optimum ratio appears to be 5:1 or greater. This is in marked contrast with prior art stretching wheeling processes in which there is no means to monitor or readily control this contact area dimensional ratio.

The distance travelled by the shaping rollers on the metal plate may be determined in a number of ways. In addition to the longitudinal tanging lines, spaced transverse lines may also be provided to enable the microprocessor to determine optically the region of deformation relative to the plate dimensions via video cameras 28. Alternatively a plurality of proximity sensors may be associated with support surfaces 22, 23, 24, 25.

Preferably however, sensors (not shown) are associated with the drive shafts of motors 8, 9 to detect the distance travelled by the rollers 4 over the surface of a metal sheet. In this manner the distance travelled along a tanging line is detected as a function of the diameter and degree of rotation of shaping rollers 4.

It will be clear to a skilled addressee that many modifications and variations will be possible with the invention without departing from the spirit and scope thereof.

For example the apparatus may be operated in a semi-automatic mode with intervention from the operator being possible. Preferably a "joystick" remote control device may be provided to enable manual override of the directional control. In addition a manual overrride may be provided to control the pressure in ram 10 or the displacement of the shapeing rollers relative to each other. By monitoring actual profile against a required profile on the VDU screen an operator can manipulate the apparatus in a manual or semi-automatic mode or override the automatic control of the apparatus. This facility may be useful in contouring a metal plate of non-standard dimensions or metallurgical properties or in the adduction of data to be employed later in standard contouring operations.

The apparatus may also include alignment means to align successive tanging lines on a metal plate to be contoured.

It will be equally clear to a skilled addressee that the apparatus and method according to the invention may be employed in a wide variety of fields in which contouring of metal plates or other plastically deformable sheet material is required. For example the apparatus may be used in the boilermaking industry to form curved ends of cylindrical pressure vessels, in the steel fabrication industry for formation of structural members and the like, or in aircraft or automotive industries for shaping of panels. Similarly, although the above description has been limited to metal plates, other plastically deformable sheets of synthetic materials such as plastics may be contoured according to the present invention. Such plastics could comprise, for example, partially cured thermosetting or thermoplastic compounds which may be contoured while in a stable plastic state prior to subsequent curing by conventional methods. The invention may also be applicable to laminated sheets of plastically deformable materials such as a plastics/metal laminate and for certain plastics materials the contoured metal layer may comprise a support or mould for the plastics layer during a curing process.

I claim:

1. An apparatus for contouring sheet material, said apparatus comprising:

a support frame for supporting at least two roller assemblies, said two roller assemblies being rotatable about spaced substantially parallel rotational axes, at least one of said roller assemblies including a roller member with at least two roller elements;

drive means for rotatably driving at least one of said roller assemblies, said drive means further including independently controllable drives coupled to each of said roller elements; and proximity control means for displacing at least one of said roller assemblies relative to another roller assembly, said proximity control means being selectively operable under the influence of pressure sensing means and/or displacement measuring means.

2. The apparatus of claim 1 wherein one or more of said at roller assemblies is a rotatable turret assembly including a plurality of roller members spaced about an outer portion of said turret assembly.

3. The apparatus of claim 1 wherein said two roller assemblies comprise an upper roller assembly and a lower roller assembly.

4. The apparatus of claim 3 wherein said upper roller assembly can be displaced relative to said lower roller assembly along an axis perpendicular to said rotational axes.

5. The apparatus of claim 4 wherein displacement of said upper roller assembly is controlled by said proximity control means in response to a predetermined pressure applied by a roller assembly to the sheet material to be contoured.

6. The apparatus of claim 4 wherein displacement of said upper roller assembly is controlled by said proximity control means in response to a predetermined displacement of said upper roller assembly with respect to said lower roller assemblies.

7. The apparatus of claim 3 wherein said roller member associated with said upper roller assembly comprises a unitary roller member and said roller member associated with said lower roller assembly comprises a plurality of roller elements.

8. The apparatus of claim 3 wherein roller members associated with both said upper and lower roller assemblies each comprise a plurality of roller elements.

9. The apparatus of claim 1 wherein one of said roller assemblies is driven and one of said roller assemblies is freely rotatable, the displacement between said driven roller assembly and said freely rotatable roller assembly being selectively adjustable.

10. The apparatus of claim 1 wherein roller members associated with said two roller assemblies have substantially complementary cross sectional shapes.

11. The apparatus of claim 1 further comprising support means for supporting the undersurface of the sheet of material to be contoured.

12. The apparatus of claim 11 wherein said support means comprises one or more support faces movable to support a contoured sheet of material.

13. The apparatus of claim 1 wherein said proximity control means includes a microprocessor.

14. A method for contouring plastically deformable sheet material, said method including the step of rolling a plastically deformable sheet material between opposed roller assemblies along predetermined tanging lines, at least one of said opposed roller assemblies comprising a roller member having at least two roller elements driven by independently controllable drives coupled with respective roller elements, said respective roller elements being independently driven to guide said sheet material bewteen said roller assemblies along said predetermined tanging lines to develop in said sheet material a contour of predetermined configuration.

15. The method of claim 14 further including the step of supporting the undersurface of the sheet material during contournig.

16. The method of claim 14 wherein the area of surface contact between a roller member and a respective region of contact on the sheet material has a dimensional ratio of greater than 3:1 measured over the perpendicular axes, the greater of which is parallel to the rotational axis of said roller member.

17. The method of claim 16 wherein said ratio is greater than 4:1.

18. The method of claim 16 wherein the said ratio is greater than 5:1.

* * * * *